US007196663B2

(12) United States Patent
Bolzer et al.

(10) Patent No.: US 7,196,663 B2
(45) Date of Patent: Mar. 27, 2007

(54) DIELECTRIC RESONATOR TYPE ANTENNAS

(75) Inventors: Francoise Le Bolzer, Rennes (FR); Corinne Nicolas, La Chapelle des Fougeretz (FR); Delia Cormos, Rennes (FR); Raphael Gillard, Rennes (FR); Alexandre Laisne, Avranches (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/659,653

(22) Filed: Sep. 9, 2003

(65) Prior Publication Data

US 2004/0130489 A1 Jul. 8, 2004

(30) Foreign Application Priority Data

Sep. 9, 2002 (FR) ..... 02/11114

(51) Int. Cl.
*H01Q 1/38* (2006.01)

(52) U.S. Cl. ..... 343/700 MS; 343/702; 343/846

(58) Field of Classification Search ..... 343/700 MS, 343/702, 749, 785, 789, 790, 829, 846, 848, 343/860, 861, 862, 873, 898, 899, 900, 905; 333/202, 204, 206, 210
See application file for complete search history.

(56) References Cited

U.S. PATENT DOCUMENTS 6,198,450 B1 * 3/2001 Adachi et al. ..... 343/753
6,304,220 B1 * 10/2001 Herve et al. ..... 343/700 MS
6,323,824 B1 * 11/2001 Heinrichs et al. ..... 343/846
6,542,124 B1 * 4/2003 Yoon ..... 343/700 MS
6,621,381 B1 * 9/2003 Kundu et al. ..... 333/202

FOREIGN PATENT DOCUMENTS

JP 2001-203513 A * 7/2001
JP 2001-257503 A * 9/2001

OTHER PUBLICATIONS

Tam , M.T.K. et al: "Half volume dielectric resonator antenna designs", Electronics Letters, vol. 33, No. 23.

* cited by examiner

*Primary Examiner*—Trinh Vo Dinh
(74) *Attorney, Agent, or Firm*—Joseph J. Laks; Robert D. Shedd; Brian J. Cromarty

(57) ABSTRACT

The present invention relates to a dielectric resonator antenna comprising a block (10) of dielectric material of which a first face intended to be mounted on an earth plane is covered with a metallic layer (11). According to the invention, at least one second face perpendicular to the first face is covered with a partial metallic layer (12) having a width less than the width of this second face. The invention applies in particular to DRA antennas for domestic wireless networks.

9 Claims, 4 Drawing Sheets

DIELECTRIC RESONATOR TYPE ANTENNAS

BACKGROUND OF THE INVENTION

The present invention relates to antennas of compact dielectric resonator type, more particularly antennas of this type intended to be used in RF circuits for wireless communications, especially for the mass market.

Within the framework of the development of antennas associated with mass-market products for domestic wireless networks, antennas of the dielectric resonator type or DRA (Dielectric Resonator Antenna) exhibit interesting properties in terms of passband and radiation. Moreover, this type of antenna is perfectly suited to a use in the form of surface mounted discrete components or CMS components. Specifically, an antenna of dielectric resonator type consists essentially of a block of dielectric material of any shape which is characterized by its relative permittivity $\epsilon r$. As mentioned in particular in the article "Dielectric Resonator Antenna—A Review And General Design Relations For Resonant Frequency And Bandwidth" published in International Journal of Microwave and Millimeter-Wave Computer-Aided Engineering—volume 4, No. 3, pages 230–247 in 1994, the passband and the size of an antenna of dielectric resonator type are inversely proportional to the dielectric constant $\epsilon r$ of the material constituting the resonator. Thus, the lower the dielectric constant, the more wideband is the DRA but the larger it is; conversely, the higher the dielectric constant $\epsilon r$ of the material forming the DRA, the smaller is the size of the DRA but in this case, it exhibits a narrow passband. Thus, to be able to use antennas of this type in domestic wireless networks complying with the WLAN standard, it is necessary to find a compromise between the size of the dielectric resonator and the passband, while proposing minimum bulk allowing integration into equipment.

As regards various solutions making it possible to reduce the size of dielectric resonators, a conventionally used solution consists in exploiting the symmetry of the fields inside the resonator to define cutting planes where it is possible to apply electric or magnetic wall conditions. A solution of this type is described in particular in the article entitled "Half volume dielectric resonator antenna designs" published in Electronic Letters of 06 Nov. 1997, volume 33, No. 23 pages 1914 to 1916, By using the fact that, in the planes defined with constant x and z, the electric field inside a dielectric resonator type antenna in $TE^y_{111}$ mode exhibits a uniform orientation and an axis of symmetry with respect to a straight line perpendicular to this orientation, it is possible to apply the theory of images and to halve the size of the DRA by effecting a cut in the plane of symmetry and by replacing the truncated half of the DRA by an infinite electric wall, namely a metallization. One thus goes from a rectangular shape of DRA represented in FIG. 1 to the shapes represented in FIGS. 2 and 3. More specifically, the rectangular dielectric resonator type antenna of FIG. 1 exhibits dimensions a, b and 2*d that have been estimated for a dielectric of permittivity $\epsilon r$=12.6 operating according to the $TE^y_{111}$ mode at 5.25 GHz frequency and that are such that a=10 mm, b=25.8 mm and 2*d=9.6 mm. If a first electric wall is made in the plane z=0 as represented in FIG. 2, in this case the rectangular DRA exhibits dimensions b and a identical to those of the DRA of FIG. 1 but a height d that is halved. Moreover, a metallization represented by the reference 1 enables an electric wall to be made in the plane z=0, According to the embodiment of FIG. 3, a second cut can be made using the symmetry of the plane z=d, and in this case one obtains an electric wall made at x=0 by the metallization 2. Hence, the dielectric resonator exhibits dimensions equal to b/2, a, d. The size of the dielectric resonator type antenna has thus been reduced by a factor 4 with respect to its base topology.

BRIEF SUMMARY OF THE INVENTION

The present invention makes it possible to reduce the dimensions of the dielectric resonator type antenna even more without degrading its radiation.

As a consequence, a subject of the present invention is a dielectric resonator antenna comprising a block of dielectric material of which a first face intended to be mounted on an earth plane is covered with a metallic layer, characterized in that at least one second face perpendicular to the first face is covered with a metallic layer over a width less than the width of the second face and over a height less than or equal to the height of the second face.

Preferably to obtain good results, the metallic layer covering the second face is centred with respect to the width of the said second face. According to another characteristic of the present invention, the metallic layer covering the second face is extended via a metallic layer covering a third face parallel to the first face. Preferably, the metallic layer covering the third face stretches over a width less than the length of the third face. According to another characteristic, the width of the metallic layer covering the third face is different from the width of the metallic layer covering the second face.

In this case, as described hereinbelow, an even more compact DRA than the DRAs described hereinabove is obtained. The effect of reducing the size can be explained by the lengthening of the field lines inside the dielectric resonator type antenna. Specifically, new boundary conditions which deform the field lines while lengthening them are imposed on the electric field by the partial metallizations.

BRIEF DESCRIPTION OF THE DRAWINGS

Other characteristics and advantages of the present invention will become apparent on reading the description of various embodiments, this description being given with reference to the hereinappended figures in which.

DESCRIPTION OF PREFERRED EMBODIMENTS

Figure 4:
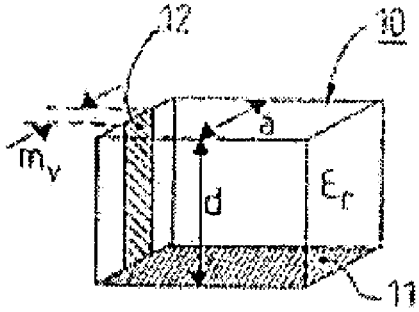
FIG. 4 is a diagrammatic perspective view of an antenna of dielectric resonator type according to a first embodiment of the present invention.

Represented diagrammatically in perspective in FIG. 4 is a first embodiment of an antenna of compact dielectric resonator type in accordance with the present invention. The dielectric resonator consists essentially of a block 10 of dielectric material. The dielectric material which exhibits a specific permittivity $\epsilon r$ may be a material based on ceramic or a metallizable plastic of the polyetherimide (PEI) type filled with dielectric or polypropylene (PP). In the embodiment represented, the block is of rectangular shape but it is obvious to the person skilled in the art that the block could have any other shape, in particular a square shape or even a cylindrical or polygonal shape. In a known manner, to decrease the size of the block, the lower surface intended to be laid down on a substrate with earth plane is covered with a metallic layer 11. In accordance with the present invention, one of the faces perpendicular to the face covered with the metallic layer 11 is also covered with a partial metallic layer 12. The metallic layers are made for example from silver, chromium, nickel or with copper/nickel or copper/tin multilayers, it being possible for the deposition to be performed either by screen-printing a conducting ink in the case of a ceramic base such as alumina or by electrochemical deposition in the case of a metallizable plastic. In this case, use is preferably made of a multilayer, namely a layer of chemical copper for fastening to the plastic followed by an electrolytic copper to improve the surface state covered by a deposition of nickel or of tin to avoid any corrosion phenomenon. The metallization may also be carried out by vacuum deposition of metals of the silver, chromium, nickel type. In this case, the thickness of the depositions is close to a micron.

In the case of the block of FIG. 4, the metallization layer 12 has been deposited over the entire height of the block.

Figure 5:
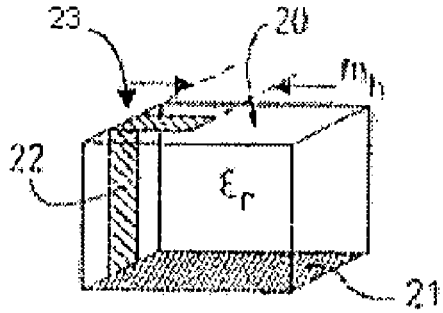
FIG. 5 is a view similar to that of FIG. 4 according to another embodiment of the present invention.

Another embodiment of the present invention will now be described with reference to FIG. 5. In this case the dielectric resonator type antenna consists of a rectangular block 20 made of a dielectric material of permittivity $\epsilon r$. Just as for the antenna of FIG. 4, a metallic layer 21 has been deposited on the face 20 of the block. This face is mounted on the substrate with earth plane. Likewise, in accordance with the present invention, a metallic layer 22 of width less than the width of one of the vertical faces of the block 20 has been deposited on the said face and in accordance with another characteristic of the present invention, this layer 22 is extended via a metallic layer 23 deposited on the face 20 of the block parallel to the face carrying the metallic layer 21. As represented in FIG. 5, the layer 23 exhibits a length $m_h$ less than the length of the face on which it is deposited.

Figure 8:
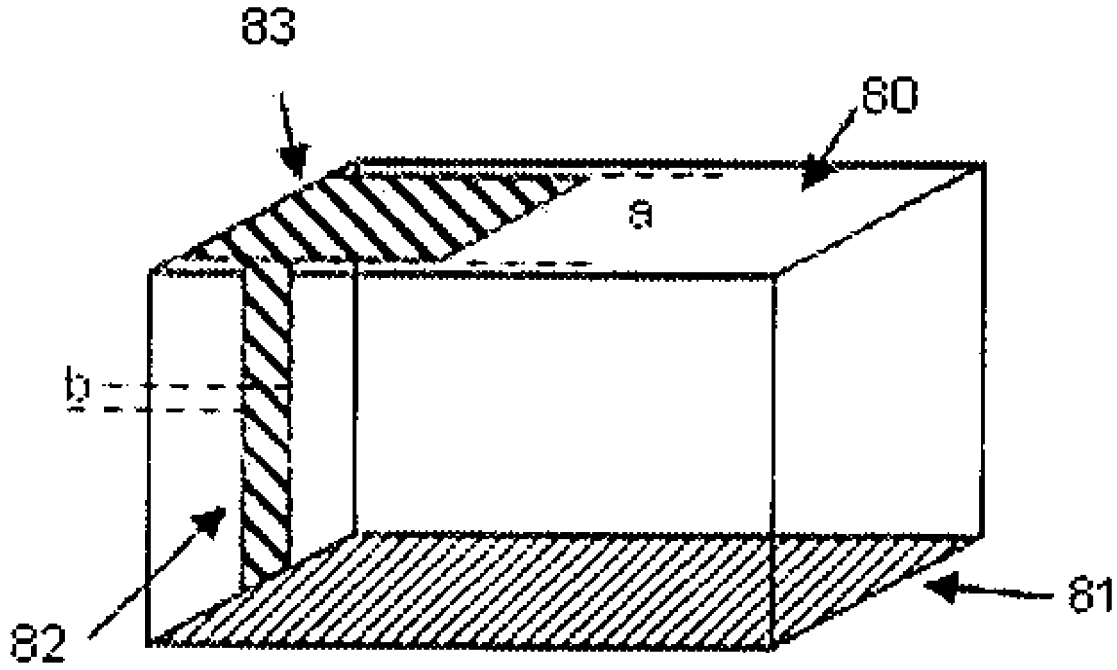
FIG. 8 is a similar view to that of FIG. 5 according to another embodiment of the present invention.

In the case of the block 80 of FIG. 8, the metallic layer 82 of width less that one of the vertical faces of the block 80 has been deposited on one of the vertical faces of the block 80. Just as for the antenna of FIG. 5, the metallic layer 82 has been extended via a metallic layer 83 across the face of the block 80 parallel to the face carrying the metallic layer 81. However, in the embodiment shown in FIG. 8, the width (a) of the metallic layer 83 across the face of the block 80 parallel to the face carrying the metallic layer 81 is different from the width (b) of the metallic layer 82 deposited on one of the vertical faces.

Figure 1:
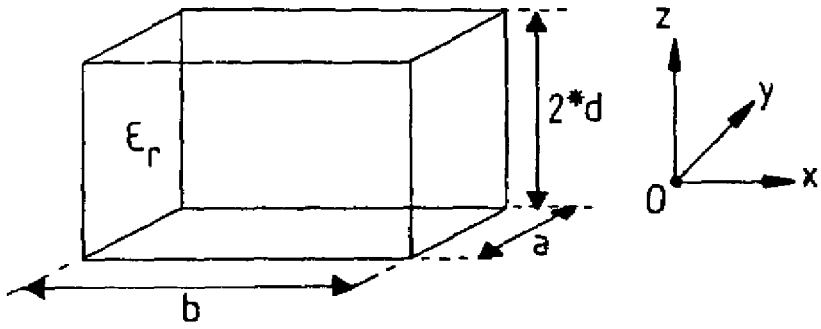
FIG. 1 already described is a diagrammatic perspective view of a base antenna of dielectric resonator type formed by a rectangular block.
Figure 2:
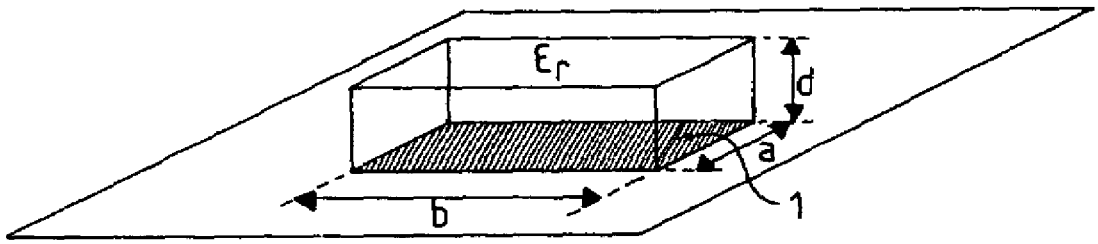
FIG. 2 already described represents a DRA in perspective of rectangular shape furnished with a metallized face shown on a wide earth plane.

To demonstrate the reduction in size of a dielectric resonator type antenna such as made according to FIGS. 4 and 5, a dimensioning of the various topologies has been performed on the basis of 3D electromagnetic simulation software based on the FDTD "Finite Difference Time Domain" method. An antenna of rectangular dielectric resonator type has therefore been simulated, fed through a slot via a microstrip line. This structure is represented in FIGS. 6*a*, 6*b*, 6*c*. In this case, the block 30 furnished with metallizations just as in the case of FIG. 5 is mounted on a substrate 31. The substrate 31 is a dielectric substrate of permittivity $\epsilon'r$ characterized by its weak RF qualities, namely exhibiting considerable dispersion in its dielectric characteristics and considerable dielectric losses. As represented in FIG. 6*a*, the two external faces of the substrate 31 have been metallized, namely the upper face by a layer 32 forming an earth plane and the lower face by a layer in which the microstrip line 33 has been etched. The DRA is fed in conventional manner through a slot 34 made in the earth plane situated on the upper surface, by the microstrip line 33 etched on the lower face. The DRA has been dimensioned according to the various topologies described in FIGS. 1, 2, 3, 4 and 5 in such a way as to operate at 5.25 GHz on a substrate of type FR4 ($\epsilon'r$=4.4, h=0.8 mm). The DRA is made in a dielectric of permittivity $\epsilon r$=12.6, As represented in FIG. 6*b*, the feed system (slot and line) is centred on the width a of the DRA: D2=a/2, In this case, the feed line exhibits a characteristic impedance 50 Ω ($w_m$=1.5 mm) and the dimensions of the slot 34 are equal to $w_S$ and $L_S$. The microstrip line 33 crosses the slot 34 perpendicularly, as represented clearly in FIG. 6*c*, with an overhang m with respect to the centre of the slot. The position of the slot is labelled via the dimension D1. For the configurations corresponding to FIGS. 2 and 3, the DRA is laid on an infinite earth plane while for the configuration corresponding to FIG. 5, namely to one of the embodiments of the present invention, the DRA is placed at the margin of the earth plane as represented in FIG. 6*b*. The dimensions obtained for the various configurations of DRA are given in Table 1 below.

TABLE 1

Figure 6:
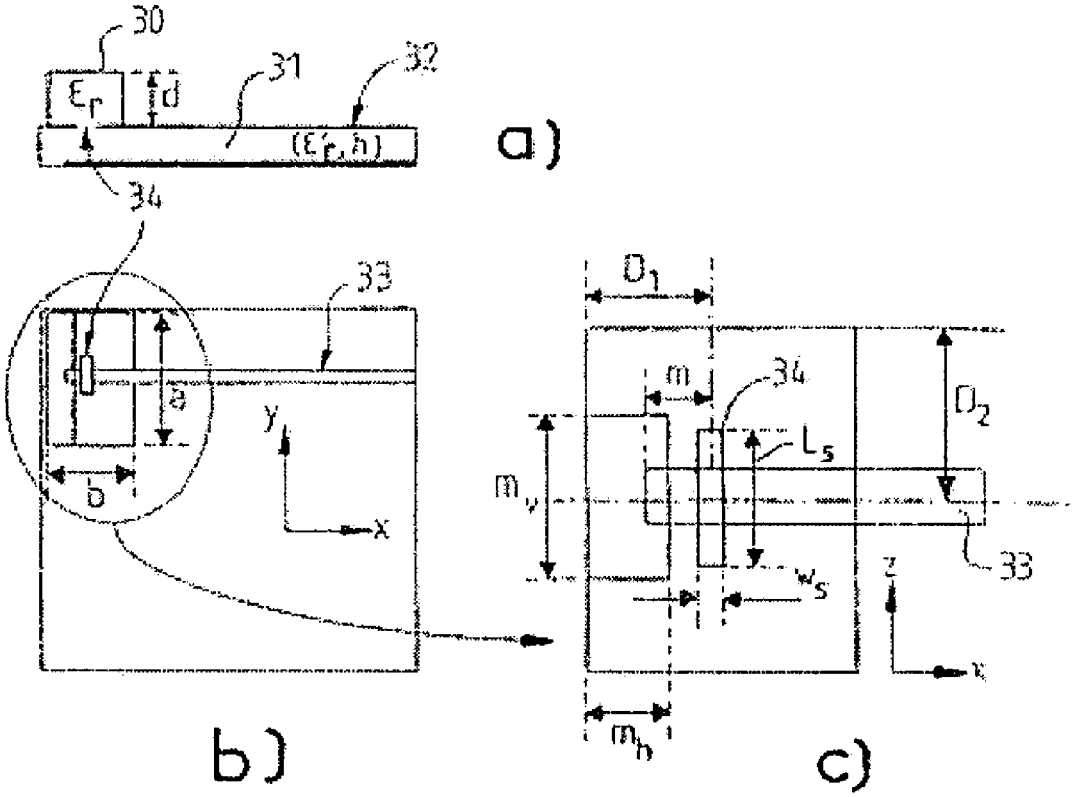
FIGS. 6*a*, 6*b* and 6*c* represent a dielectric resonator antenna fed by microstrip line.

| $\epsilon r$ = 12.6 | a (mm) | b (mm) | Height (mm) | $L_s$ (mm) | $w_s$ (mm) | m (mm) | $m_v$ (mm) | $m_h$ (mm) | D1 (mm) |
|---|---|---|---|---|---|---|---|---|---|
| Base DRA | 10 | 25.8 | 2*d = 9.6 | 6 | 2.4 | 3.3 | 0 | 0 | 0 |
| DRA on earth plane | 10 | 25.8 | d = 4.8 | 6 | 2.4 | 3.3 | 0 | 0 | 0 |
| ½ DRA | 10 | 12.9 | d = 4.8 | 7.5 | 1.2 | 3.6 | 10 | 0 | 9 |
| DRA FIG. 6 | 8.5 | 6 | d = 4.8 | 8 | 1.2 | 3 | 5 | 1.8 | 5.1 |

As may be seen clearly, the DRA of FIG. 6 exhibits a length a of 8.5 instead of a length of 10 for the other DRAs, a width b of 6 instead of widths varying between 12.9 and 25.8 and a height d equal to 4.8 instead of a height varying between 4.8 and 9.6, Therefore, with a DRA in accordance with the present invention one obtains a further reduction factor of 3 with respect to the ½ DRA.

More generally, the dielectric resonator type antenna is firstly dimensioned using the cutting principle along two planes of symmetry, as described in the Electronic Letters article mentioned above. Partial metallizations are deposited as described above. The partial metallizations whose dimensions depend in particular on the material used, bring about a decrease in the operating frequency of the DRA. Consequently, the dimensions a and b are adapted so as to come down to the desired frequency.

Figure 3:
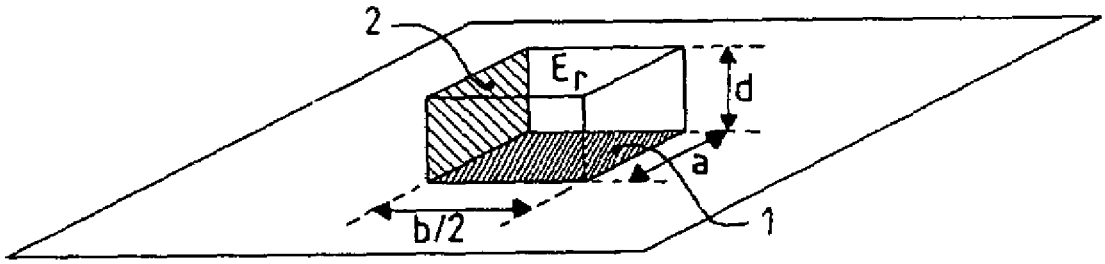
FIG. 3 already described is a diagrammatic perspective view of an antenna of compact dielectric resonator type on an earth plane.
Figure 7:
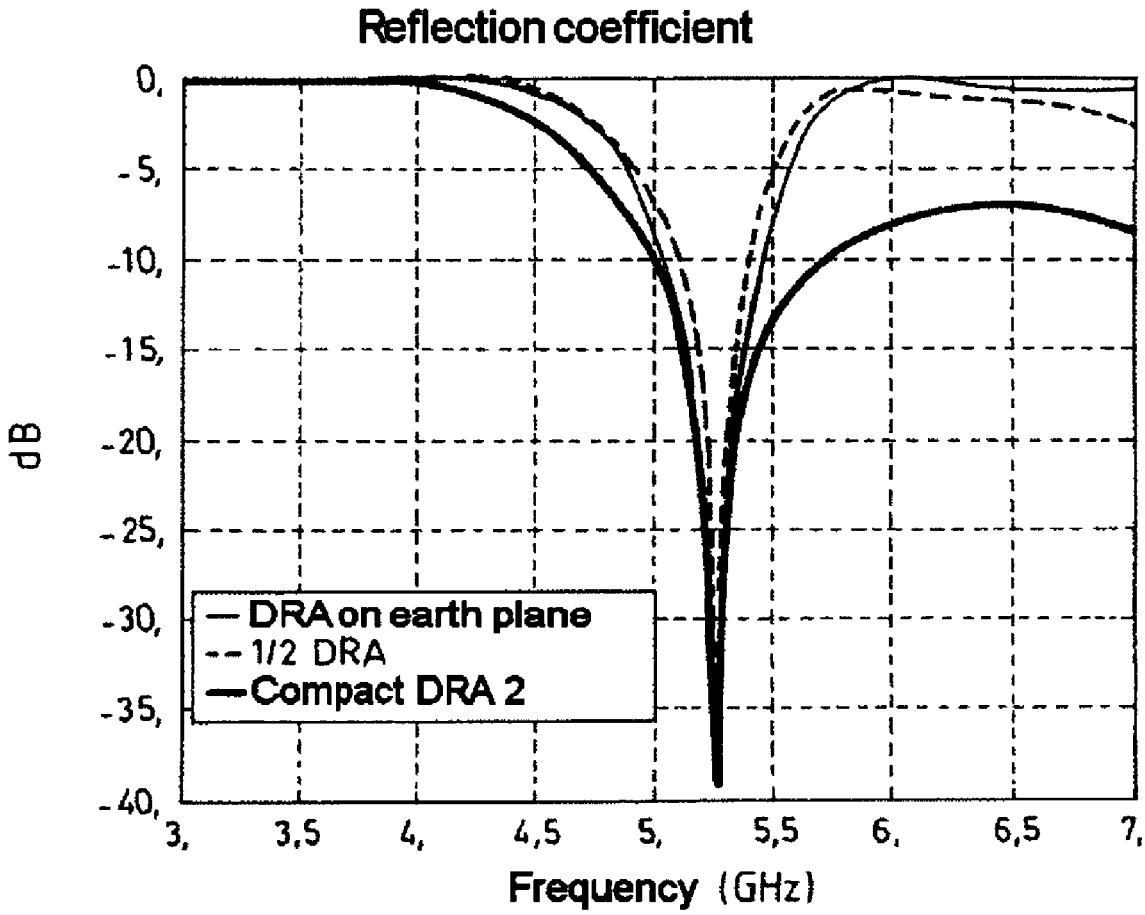
FIG. 7 represents a curve giving the reflection coefficient S11 as a function of frequency for various topologies of compact DRA.

Moreover, as represented in FIG. 7 giving the reflection coefficient S11 as a function of frequency, it is seen that the DRA of FIG. 5 gives an adaptation level comparable to the DRAs of FIGS. 3 and 4.

The embodiments described above may be varied through embodiment alternatives. In particular, the width of the partial metallization layer of the second face may be different from the width of the metallization layer of the third face.

With the configuration of the present invention, the size of the DRA is therefore considerably reduced while obtaining comparable performance.

What is claimed is:

1. Dielectric resonator antenna comprising a block of dielectric resonator having a first face intended to be mounted on earth plane and entirely covered with a first metallic layer, wherein at least one second face perpendicular to the first face is covered with a second metallic layer contacting said metallic layer covering said first face, said second metallic layer covering said second face extending over a width less than the width of the second face and over a height less than or equal to the height of the second face, and wherein said block of dielectric resonator comprises a third face being at least partially unbounded by conductive material so as to emit radiation from said third face.

2. The antenna according to claim 1, wherein the second metallic layer covering the second face is centred with respect to the width of the said second face.

3. The antenna according to claim 1, wherein the second metallic layer covering the second face is extended via a third metallic layer covering a third face parallel to the first face.

4. The antenna according to claim 3, wherein the third metallic layer covering the third face stretches over a width less than the length of the third face.

5. the antenna according to claim 3, wherein the width of the third metallic layer covering the third face is different from the width of the second metallic layer covering the second face.

6. Dielectric resonator antenna comprising a single block of dielectric material having a first face, a second face, and a third face said block of dielectric material being mounted on a substrate with a face forming ground plane, the black of dielectric material having said first face mounted on said substrate entirely covered with a first metallic layer and said second face perpendicular to said first facc covered with a second metallic layer contacting said first metallic layer covering said first face, said second metallic layer covering said second face extending over a width less than the width of said second face and a height less than or equal to the height of said second face, said dielectric resonator being excited through a slot provided in the substrate and a microstrip line provided on a face of the substrate opposite to the face forming ground plane crossing said slot, and said third face being at least partially unbounded by conductive material so as to emit radiation from said third face.

7. The antenna according to claim 6, wherein the second metallic layer covering the second face is extended via a third metallic layer covering a third face parallel to the first face.

8. The antenna according to claim 7, wherein the third metallic layer covering the third face stretches over a width less than the length of the third face.

9. The antenna according to claim 8, wherein the width of the third metallic layer covering the third face is different from the width of the second metallic layer covering the second face.

* * * * *